United States Patent [19]

Horgan, Jr.

[11] 4,155,540

[45] May 22, 1979

[54] SUSPENDED RAIL

[75] Inventor: William J. Horgan, Jr., Pittsburgh, Pa.

[73] Assignee: Blumcraft of Pittsburgh, Pittsburgh, Pa.

[21] Appl. No.: 856,209

[22] Filed: Nov. 30, 1977

[51] Int. Cl.[2] ..... E04F 11/18

[52] U.S. Cl. ..... 256/23; 256/24

[58] Field of Search ..... 256/23, 24, 59, 65, 256/66, 67, 68, 69, 70, 31; 52/71, 184, 239, 400, 698; 156/304; 428/58

[56] References Cited

U.S. PATENT DOCUMENTS

| | | | |
|---|---|---|---|
| 3,293,812 | 12/1966 | Hammitt | 256/24 |
| 4,010,933 | 3/1977 | Hebda | 256/23 |
| 4,067,548 | 1/1978 | Murphy | 256/65 X |

FOREIGN PATENT DOCUMENTS

| | | | |
|---|---|---|---|
| 615470 | 2/1961 | Canada | 256/24 |
| 2025687 | 7/1971 | Fed. Rep. of Germany | 256/59 R |
| 2456239 | 8/1976 | Fed. Rep. of Germany | 156/304 |

*Primary Examiner*—Werner H. Schroeder
*Attorney, Agent, or Firm*—Paul & Paul

[57] ABSTRACT

An ornamental railing is provided which includes a plurality of glass or plastic panels suspended from a handrail. The panels provide vertical support for the handrail, acting as gussets between the handrail and its support means. The panels do not touch the staircase or floor below, and thus do not interfere with construction or maintenance of risers, treads, or landings.

19 Claims, 8 Drawing Figures

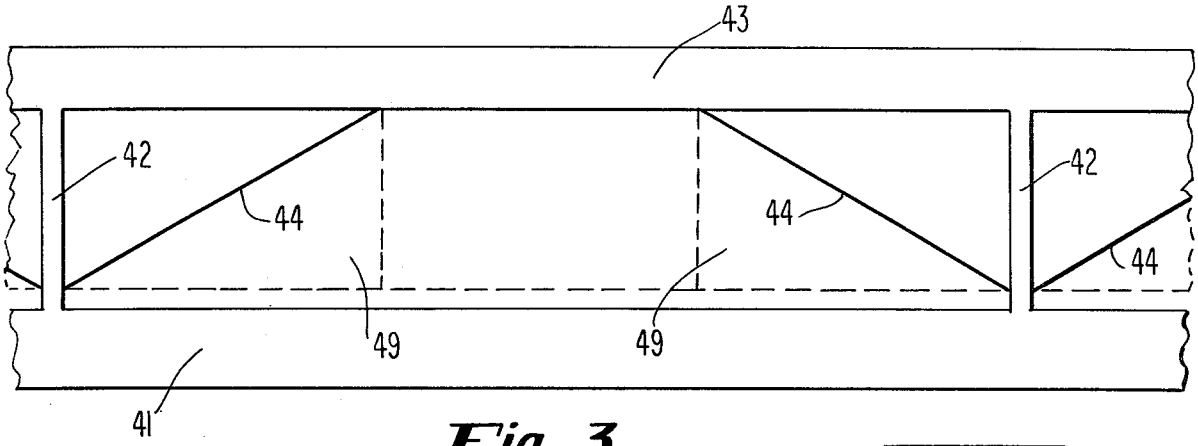
Fig. 3
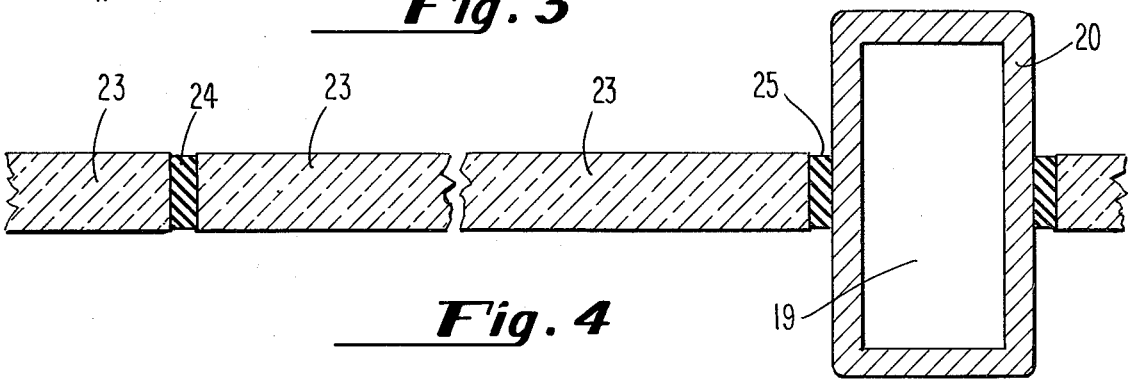
Fig. 4
Fig. 5
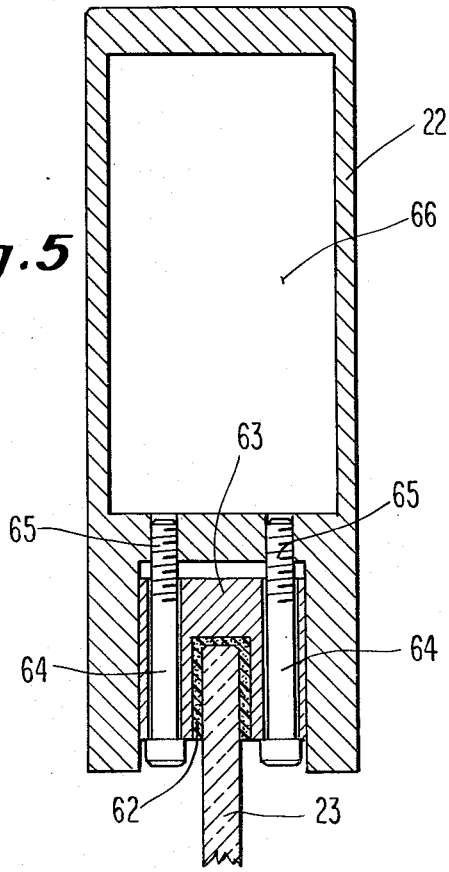
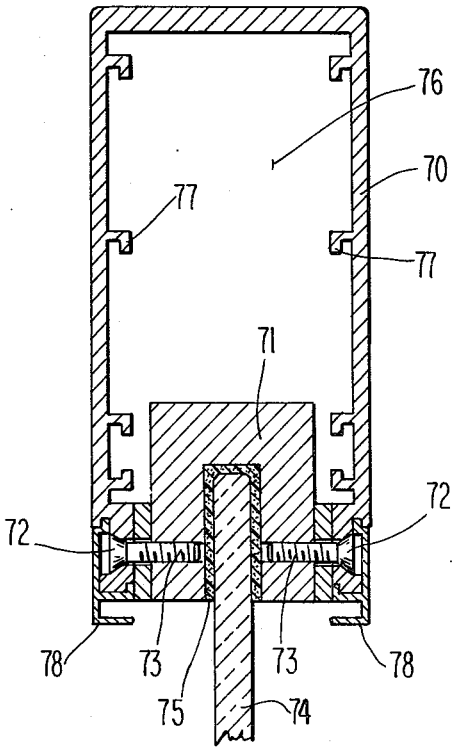
Fig. 6

SUSPENDED RAIL

BACKGROUND OF THE INVENTION

This invention relates to ornamental railings made of glass or plastic panels. Glass railings have been in existence for some time. They have great aesthetic value, creating the illusion of a handrail floating in mid-air. For example, such a glass panel railing is disclosed in Kohn and Sugar, U.S. Pat. No. 903,730. Until recently, however, an independent support means for the railing was needed, as the glass panel alone could not support the railing.

The problem of self-supporting glass railings was recently solved by Blum, Re. No. 28,643. The invention of Blum disclosed a closed structure, in which the glass panels extended all the way from the handrail to the floor or support for the staircase. Also, the glass panels constituted the sole vertical support means for the railing.

SUMMARY OF THE INVENTION

This invention provides a unique ornamental railing which combines aesthetic attractiveness with practical structural advantages. The railing, in a typical embodiment, consists of glass or plastic panels suspended from a hand-rail, in such a manner as to provide vertical support for the railing, and where the panels do not touch the staircase or floor below. Thus, the attractiveness of a glass panel railing is combined with the ridigity provided by this invention, and in addition, the railing does not interfere with the riser or treads of the staircase, thus facilitating the initial pouring of terrazzo, concrete, or the laying of stone or carpeting.

In practicing this invention, glass or plastic panels are permanently bonded into "U" channels. These resulting panel sub-assemblies are then bolted into the handrail which is supported by posts, columns, or brackets attached to walls. The result is a railing having suspended glass or plastic panels which can be removed and replaced without disturbing the handrail.

It is a primary object of this invention to provide an ornamental railing having suspended glass or plastic panels. It is a further object of this invention to provide vertical support for a handrail by the use of glass or plastic panels.

It is a further object of this invention to provide an ornamental railing which does not interfere with the floor, or with the risers or treads below the railing.

It is a further object of this invention to provide an ornamental railing which can be used with or without the series of glass or plastic panels.

It is a further object of this invention to provide a railing whose panels can be easily removed and replaced without disturbing the handrail.

Other objects and advantages of this invention will be readily apparent, to those skilled in the art, from a reading of the following brief description of the drawings, the detailed description of the invention and the appended claims.

BRIEF DESCRIPTION OF THE DRAWINGS

FIG. 3 is a diagrammatic view of the section of railing in FIG. 1, showing the manner in which panels act as force-transmitting gussets between the handrail and posts.

FIG. 4 is a fragmentary view of the glass or plastic panel, and of a supporting post, taken along the line IV-IV in FIG. 1.

FIG. 5 is a cross-sectional view of a railing, a holding member, and part of a panel attached, taken along the line V—V in FIG. 1.

FIG. 6 is similar to FIG. 5, and shows an alternate form of handrail.

DETAILED DESCRIPTION OF THE INVENTION

Figure 1:
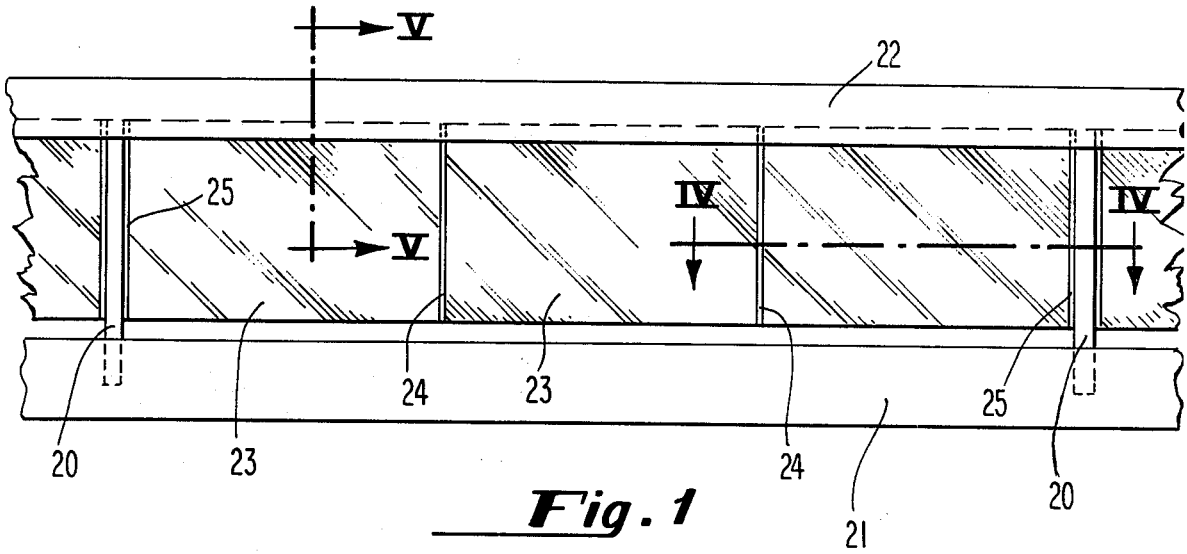
FIG. 1 is a fragmentary front elevational view of a railing made in accordance with this invention, showing two posts separated by three panels.

A horizontal section of the railing which is the subject of this invention is shown in FIG. 1. In this embodiment, support posts 20 are attached to the floor 21. The handrail 22, typically constructed of extruded aluminum or steel, is attached to the tops of the posts 20 and extends horizontally in this figure. Panels 23, typically made of rigid construction such as one-half inch tempered glass, are suspended from the handrail 22 by an attaching means, described below. Substantially solid strips of a clear, rubber-like material 24 (which may originally be of a liquid, jelly, or even solid construction) is forced into the spaces between adjacent panels 23 after the panels 23 have been attached to the handrail 22. The same is true for the strips 25 between the panels 23 and the posts 20. It is important to note that the panels 23 do not touch the floor 21; they are truly suspended from the handrail 22.

Figure 2:
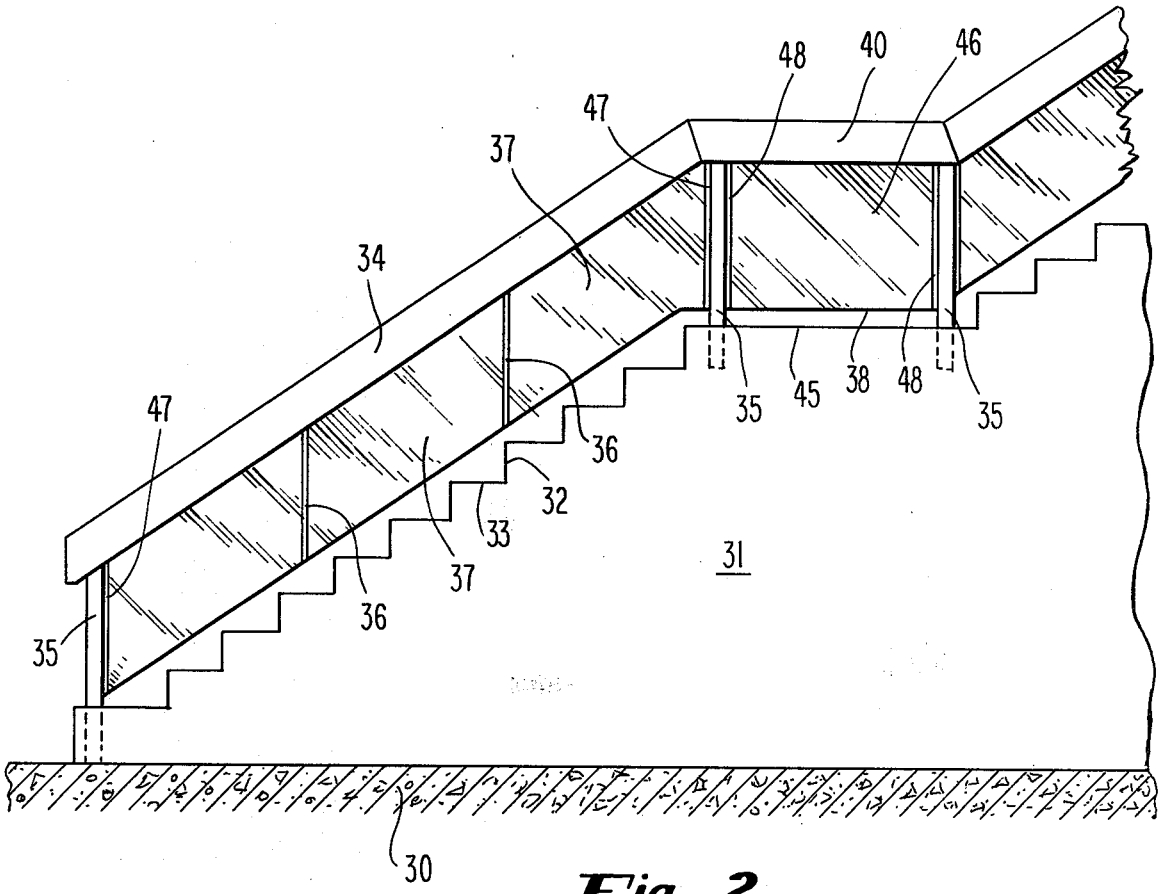
FIG. 2 is a front elevational view of a section of a railing, showing the railing as it appears along both a staircase and a landing.

FIG. 2 shows an alternative use of the invention, in the form of a railing along both a staircase and a landing. In this figure, posts 35 are mounted on a staircase 31 which rests on the floor 30, shown as concrete in the figure. An ascending section of handrail 34 is attached to the tops of posts 35. A horizontal section of handrail 40 is attached to the posts 35, parallel to the landing 45. The glass panels 37 along the staircase 31 are of the form of parallelograms, while the panel 46 along the landing 45 is rectangular as was shown in FIG. 1. The panels of both types, 37 an 46, are suspended from their respective handrails 34 and 40. As in the case of the version discussed above, the strips 36 between panels 37 are made of a clear rubber-like material forced between the panels 37. The same is true for the strips 47 between panels 37 and posts 35, and for the strips 48 between posts 35 and the rectangular panel 46. It is important to note that at no point does any panel 37 touch any of the risers 32 or treads 33 of the staircase 31. Nor does the panel 46 touch the landing 45. All panels 37 and 46 are suspended from the handrail, 34 and 40, only. One of the important features of the invention is illustrated diagrammatically in FIG.3. This figure is a representation of an effective force-transmitting gusset portion within the glass panels, and shows how the panels themselves provide ready-made supports for the railing. The panels 49 act as gussets 44 between the handrail 43 and the posts 42. That is, the presence of the panels 49 automatically adds support to the handrail 43 and thus tends to prevent the handrail 43 from sagging under vertical load. It is again shown in FIG. 3 that the panels 49 do not touch the floor 41, because panels 49 are suspended from the handrail 43.

The relation of the panels to each other and to adjacent posts is illustrated in FIG. 4. This figure shows in fragmentary form the panels 23 in a top cross-sectional view, connected by the clear rubber-like strips 24. The post 20 is shown in cross section, and the clear material 25 is shown separating the post 20 from the adjacent panel 23. The post 20 is of hollow construction, having a void 19, in this figure, but other types of posts or support means will also be satisfactory.

FIG.5 illustrates one means by which a glass panel may be suspended from a handrail in accordance with this invention. A glass panel 23 is permanently bonded to a "U" channel 63, making a rigid connection therewith, having a length approximately the same as that of the panel 23. The bonding is accomplished through the use of a strong adhesive 62. This panel sub-assembly 23 and 63, is then attached to the handrail 22 through the use of the two bolts 64 which are threaded as shown at 65. In the particular style of handrail 22 of FIG. 5, the space 66 inside the handrail is empty.

The panel sub-assembly, 23 and 63, can be readily removed from the handrail 22 by unscrewing the bolts 64. When this is done, the space formerly occupied by the panel sub-assembly 21 and 63, and by the bolts 64, is empty, but the handrail 22 still remains attached to the support means, not shown in FIG. 5, and the handrail 22 can still function alone as a railing. The handrail 22 is strengthened by the presence of the panel sub-assembly 23 and 63; the handrail 22 receives vertical support due to the fact that the panel 23 now acts as a gusset between the handrail 22 and the support means 20.

FIG. 6 shows an alternative structure to FIG. 5, by which the glass panels may be attached to the handrail. The handrail 70 in FIG. 6 is of slightly different shape from that in FIG. 5, having small rigidifying longitudinal protrusions 77 extending into the hollow space 76 inside the handrail 70. Again, the glass panel 74 is permanently bonded by means of an adhesive 75 to a "U" channel 71, and the resulting panel sub-assembly, 74 and 71, is bolted to the handrail 70 by means of bolts 72 having threads 73. The handrail 70 also has longitudinal screw-head-cover molding strips 78 snapped into place. These strips 78 completely hide the bolts 72 from view, and create an aesthetically pleasing whole view of the handrail 70. In similar fashion to the embodiment of FIG. 5, the panel sub-assembly 74 and 71 of FIG. 6 can be removed from the handrail 70, and the handrail 70 still functions alone as a railing. But when the panel sub-assembly 74 and 71 is replaced, the handrail 70, which was formerly of weaker "U" section, now becomes a much stronger structural tubular section.

Figure 7:
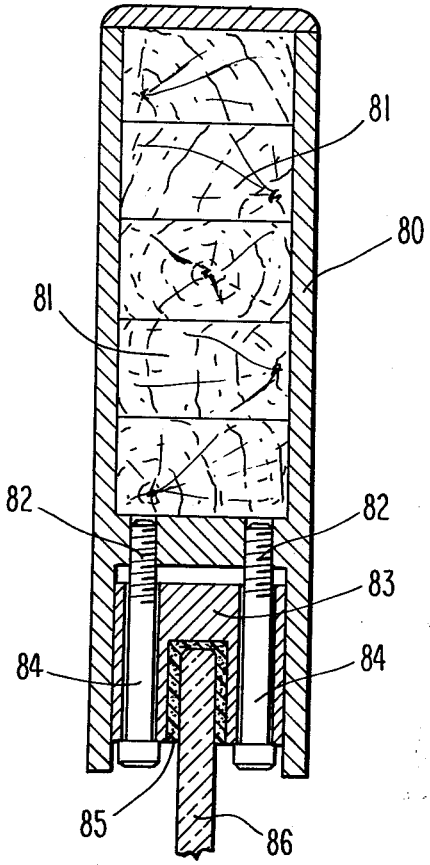
FIG. 7 is still another view, similar to FIG. 5, showing another type of handrail.

Another alternative structure for the handrail is shown in FIG. 7. Inside the handrail 80 are several longitudinal strips 81 of wood which fill the void that would otherwise exist (compare the empty space designated by the numeral 66 in FIG. 5). But, as before, the figure shows a glass panel 86 permanently bonded to a "U" channel 83 by means of an adhesive 85, and the panel sub-assembly, 86 and 83, as before, is attached to the handrail 80 through the use of the bolts 84 having threads 82.

Figure 8:
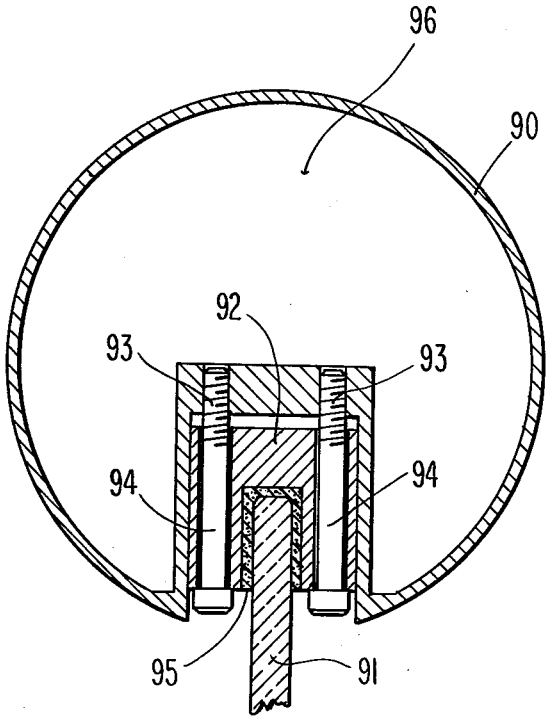
FIG. 8 is still another variation of FIG. 5, showing another type of handrail.

FIG. 8 shows yet another variation in the means by which the panels may be attached to the handrail. The handrail 90 in FIG. 8 is of circular shape and has a hollow void 96 inside. As before, the panel 91 is permanently bonded by an adhesive 95 to the "U" channel 92, and the resulting sub-assembly 91 and 93 is attached to the handrail 90 through the use of bolts 94 having threads 93.

It should be apparent that the embodiments of the invention described above are only several of many possible variations. The panels used in the railing may be constructed of plastic as well as of glass. The support means for the handrail, illustrated as a group of posts in the foregoing figures, could also take the form of columns, or even support brackets attached to walls. The floor or staircase, though illustrated as concrete, could of course be made of other materials. And, of course, there is a wide variety of possible shapes for the handrail, and methods of attaching the panels to the handrail. It is therefore understood that this invention is not limited to the particular embodiment described above.

It will be apparent that the foregoing disclosure completely describes this invention, and that the objects of the invention, set forth above, are fulfilled. This disclosure should enable one skilled in the art to practice the invention in any of its possible embodiments.

What is claimed is:

1. An ornamental railing comprising a handrail and at least one rigid panel, with mounting means carrying said panel in suspended relation from but in rigid connected relation to said handrail along the upper end of the panel, and wherein said panel is free of any bottom support along its lower end.

2. The railing of claim 1, wherein said mounting means comprises recess means in said handrail, a holding member disposed in attached relation in said recess means by readily detachable means, and means bonding said panel to said holding member.

3. The railing of claim 1, wherein said panel is of generally transparent material construction.

4. The railing of claim 1 wherein said panel is of sheet glass construction.

5. The railing of claim 1 wherein said panel is of sheet plastic construction.

6. The railing of claim 1 further comprising a support means for supporting said handrail from a building structure or the like.

7. The railing of claim 6 wherein said support means comprises at least one vertical post.

8. The railing of claim 7 wherein said panel acts as a force-transmitting suporting gusset between said support means and said handrail, under vertically applied loads.

9. The railing of claim 1, wherein said panel is of sheet glass construction, and wherein said mounting means comprises recess means in said handrail, a holding member disposed in attached relation in said recess means by readily detachable means, and means bonding said panel to said holding member, and further comprising a support means for supporting said handrail from a building structure or the like, said support means comprising at least one vertical post, wherein said panel acts as a force-transmitting supporting gusset between said support means and said handrail, and wherein there are a plurality of aligned said glass panels, with adjacent said panels having a clear rubber-like material disposed in spaces between adjacent edges of adjacent said panels.

10. An ornamental railing comprising a plurality of generally vertical posts, a handrail attached to said posts, an elongated recess in the lower end of said handrail, a plurality of "U" channels, each of said "U" channels being in removably connected relation to said handrail, a plurality of aligned rigid glass panels, said panels each being defined by top, bottom and generally vertical edges with said panels each being in rigid adhesively bonded relation to and carried by said "U" channels along top panel edges in suspended relation to said handrail, and a clear rubber-like material which fills the spaces between the vertical edges of adjacent said panels and between the vertical edges of said panels and said posts, wherein said panels are substantially free of support along their bottom edges, and wherein said panels comprise gusset-like force transmission means between said posts and said handrail in response to downward forces applied to said handrail.

11. The railing of claim 10, wherein said elongated recess is defined by an interior longitudinal protrusion extending inward from said handrail.

12. The railing of claim 10 wherein said handrail comprises a hollow extrusion filled by a plurality of longitudinal strips of wood.

13. The railing of claim 10 wherein said handrail is of generally hollow construction substantially throughout its length.

14. A kit for construction of an ornamental railing on a building structure, which kit upon assembly comprises a plurality of transparent rigid panels suspended from a handrail, with the panels being carried in suspended relation from but in rigid connected relation to the handrail along the upper ends of the panels and being easily removably from the assembled railing, said kit comprising:

a. a handrail having an elongated zone adapted for fastening of holding members thereto, b. a plurality of holding members adapted for fastening to the elongated zone of the handrail, and having an elongated groove for receiving engagements of panels therein, c. fastening members for rigidly attaching said holding members to said handrail at the elongated zone of said handrail, d. a plurality of transparent rigid panels, each having an edge adapted to be received in connected relation in the elongated groove of a holding member, e. connecting means for rigidly connecting said panels to said holding members f. a clear rubber-like material for filling spaces between adjacent said panels.

15. The kit of claim 14 further comprising a support means, adaptable for attachment to both said handrail and to a building structure for providing vertical support to said handrail from the structure.

16. The kit of claim 15 wherein said support means comprises at least one post.

17. The kit of claim 14 wherein said panels are of sheet glass construction.

18. The kit of claim 14 wherein said panels are of sheet plastic construction.

19. The kit of claim 14 wherein said connecting means comprises an adhesive for bonding said panels to said holding members.

* * * * *